US007696423B1

(12) United States Patent
Schiano

(10) Patent No.: US 7,696,423 B1
(45) Date of Patent: Apr. 13, 2010

(54) DRUM HI HAT WITH ADJUSTABLE UPPER HI HAT ROD

(76) Inventor: Mark Schiano, 216 Rockland Rd., Pearl River, NY (US) 10965

( * ) Notice: Subject to any disclaimer, the term of this patent is extended or adjusted under 35 U.S.C. 154(b) by 0 days.

(21) Appl. No.: 12/486,424

(22) Filed: Jun. 17, 2009

(51) Int. Cl.
*G10D 13/02* (2006.01)

(52) U.S. Cl. ..... 84/422.3; 84/422.2; 84/422.1; 84/421

(58) Field of Classification Search ..... 84/422.1, 84/422.2, 422.3, 421
See application file for complete search history.

(56) References Cited

U.S. PATENT DOCUMENTS

| | | | | |
|---|---|---|---|---|
| 4,381,690 | A * | 5/1983 | Kimble | 84/422.3 |
| 4,528,888 | A * | 7/1985 | Hoshino | 84/421 |
| 5,018,426 | A * | 5/1991 | Suzuki | 84/422.3 |
| 5,482,235 | A * | 1/1996 | Atsumi | 248/121 |
| 6,054,645 | A * | 4/2000 | Gauger | 84/422.3 |
| 6,075,192 | A * | 6/2000 | Hoshino | 84/422.3 |
| 6,316,708 | B1 * | 11/2001 | Kuppers | 84/422.3 |
| 6,320,109 | B1 * | 11/2001 | Kuppers | 84/422.3 |
| 6,399,865 | B1 * | 6/2002 | Ishimatsu | 84/421 |
| 6,740,799 | B1 * | 5/2004 | Liao | 84/422.3 |
| 6,930,232 | B2 * | 8/2005 | Shigenaga | 84/422.3 |
| 7,126,050 | B1 * | 10/2006 | Lombardi | 84/422.1 |
| 7,288,708 | B1 * | 10/2007 | Kassabian | 84/422.1 |
| 7,342,163 | B2 * | 3/2008 | O'Donnell | 84/422.3 |
| 2006/0169124 | A1 * | 8/2006 | Tanaka | 84/422.3 |
| 2009/0090233 | A1 * | 4/2009 | Romolino | 84/422.3 |

* cited by examiner

*Primary Examiner*—Jeffrey Donels
*Assistant Examiner*—Robert W Horn
(74) *Attorney, Agent, or Firm*—Walter J. Tencza, Jr.

(57) ABSTRACT

A drum hi hat apparatus including a first tube device, a second tube device, a third tube device, a rod, a support device, a pedal device, and a first adjusting device. The third tube device may have a first end which is configured to have a first cymbal placed on it. The rod may be configured to fit within the first, second, and third tube devices. The support device may be configured so that it is able to support the first tube device in an upright position. The first adjusting device may be configured to adjustably fix the rod to the second tube device, so that the rod extends out from the second tube device different amounts. The pedal device may be connected to the second tube device, which is adjustably fixed to the rod by a first adjusting device, so that the pedal device can pull down the second tube device and thereby pull down a second cymbal fixed to the rod to bring the second cymbal in contact with the first cymbal.

15 Claims, 7 Drawing Sheets

DRUM HI HAT WITH ADJUSTABLE UPPER HI HAT ROD

FIELD OF THE INVENTION

This invention relates to improved methods and apparatus concerning drums and more particularly drum hi hats.

BACKGROUND OF THE INVENTION

There are various devices known in the prior art related to drums and drum hi hats. Typically, in prior art hi hats, a top cymbal is adjusted in height by loosening a wing screw with respect to a first rod, sliding the top cymbal up or down the first rod and then fixing the top cymbal at a position with respect to the first rod. However, first rod is typically fixed to a second rod, which lies inside of a tube, and the combination of the first rod and the second rod has a fixed height. In prior art hi hat devices the only way to change the height of the first and second rod combination is to get a different first rod of a different height, or to cut the first rod. The fixed height of the combination of the first rod and the second rod, often may leave an unnecessary extended portion of the first rod above the top cymbal, and this unnecessary extended portion may get in the way of the drummer's playing. Worse yet, the fixed height of the combination of the first and the second rod may be too short, so that the drummer can not properly adjust the height of the top cymbal based on what level he or she is comfortable with or for ergonomic purposes.

In addition, the fixed height of the combination of the first rod and second rod, makes it difficult to transport a prior art hi hat device, unless the first rod is dismantled from the second rod. The first rod is usually dismantled from the second rod before transporting the hi hat device to avoid the first rod being damaged, such as being bent, during transport.

The second rod is fixed to a pedal device. When a foot of the pedal device is pressed down, the first and second rods move down and pull the top cymbal down with them. This brings the top cymbal in contact with a lower cymbal. However, the first and second rods are not adjustable with respect to each other.

SUMMARY OF THE INVENTION

In one or more embodiments of the present invention an apparatus is provided including a first tube device, a second tube device, a third tube device, a rod, a support device, and a pedal device. The apparatus may be used for a drum hi hat. The third tube device may have a first end which is configured to have a first or bottom drum cymbal placed on it. The rod may be configured to fit within the first, second, and third tube devices. The rod may be configured to have a second or top drum cymbal attached to it. The support device may be configured so that it is able to support the first tube device in an upright position. The pedal device may be connected to the second tube device, which is adjustably fixed to the rod, so that the pedal device can pull down the second tube device and thereby pull down a the top drum cymbal fixed to the rod to bring the top drum cymbal in contact with the bottom drum cymbal.

The second tube device may fit within both the first tube device and the third tube device. The third tube device may fit within the first tube device. The apparatus, in one or more embodiments, may also include a first adjustment device which is configured so that it can fix the rod to the second tube device at different positions so that the rod extends out different amounts from the second tube device.

The first tube device may have a first elongated slot, and the third tube device may have a second elongated slot. The first and the second elongated slots can be aligned with each other so that a portion of the first adjustment device can move within both the first elongated slot and the second elongated slot at the same time. The first adjustment device may include a protrusion, screw, or fastener, which can be tightened to hold the second tube device and the rod together at different positions, or loosened so that the rod can slide with respect to the second tube device.

The second tube device may include a spring. The pedal device may be connected to the second tube device so that pressing down with an individual's foot on the pedal device causes compression of the spring, and ceasing to press down with an individual's foot on the pedal device causes the spring to decompress. The first tube device, the second tube device, and the third tube device may include hollow cylinders.

The apparatus may further include a second adjustment device which is configured so that it can fix the third tube device to the first tube device at different positions so that the third tube device extends out different amounts from the first tube device.

In one or more embodiments of the present invention, a method is also provided which may include supporting a first tube device in an upright position, inserting a second tube device into the first tube device, inserting a third tube device into the first tube device, so that the third tube device surrounds the second tube device, and inserting a rod into the first, second, and third tube devices. The method may also include attaching the rod to the second tube device using a first adjustment device so that the rod extends out from the second tube device a first amount, detaching the rod from the second tube device, moving the rod with respect to the second tube device, attaching the rod to the second tube device using the first adjustment device so that the rod extends out from the second tube device a second amount which is different from the first amount; and placing a first or bottom drum cymbal on an end of the third tube device.

The method may further include aligning a first elongated slot of the first tube device with a second elongated slot of the third tube device before attaching the rod to the second tube device. The step of attaching the rod to the second tube device so that the rod extends out from the second tube device a first amount may include inserting a fastener into the second tube device which holds the rod in a fixed position with respect to the second tube device. Similarly, the step of attaching the rod to the second tube device so that the rod extends out from the second tube device a second amount may include inserting the fastener into the second tube device which holds the rod in a fixed position with respect to the second tube device.

The second tube device may have an opening for insertion of the fastener. The fastener may be configured to fit through the first elongated slot, through the second elongated slot, through the opening of the second tube device, and contact with the rod in order to hold the rod in a fixed position with respect to the second tube device.

The method may also include attaching the second tube device to a pedal device so that when an individual presses down with their foot on the pedal device the second tube device is pulled down, and the rod, when attached to the second tube device, is also pulled down. The method may also include fixing the third tube device to the first tube device at different positions using a second adjustment device so that the third tube device extends out different amounts from the first tube device.

One or more embodiments of the present invention allow a rod to slide inside of the second tube device or sleeve, so that the height of the combination of the rod and the second tube device can be adjusted to various heights to the drummer's satisfaction. This avoids bent rods due to the rod extending too far past the top cymbal. This also allows the rod to be pushed into the second tube device, i.e. in a telescoping effect, so that the hi hat device can be transported without the rod extending far out from the second tube device.

DETAILED DESCRIPTION OF THE DRAWINGS

Figure 1:
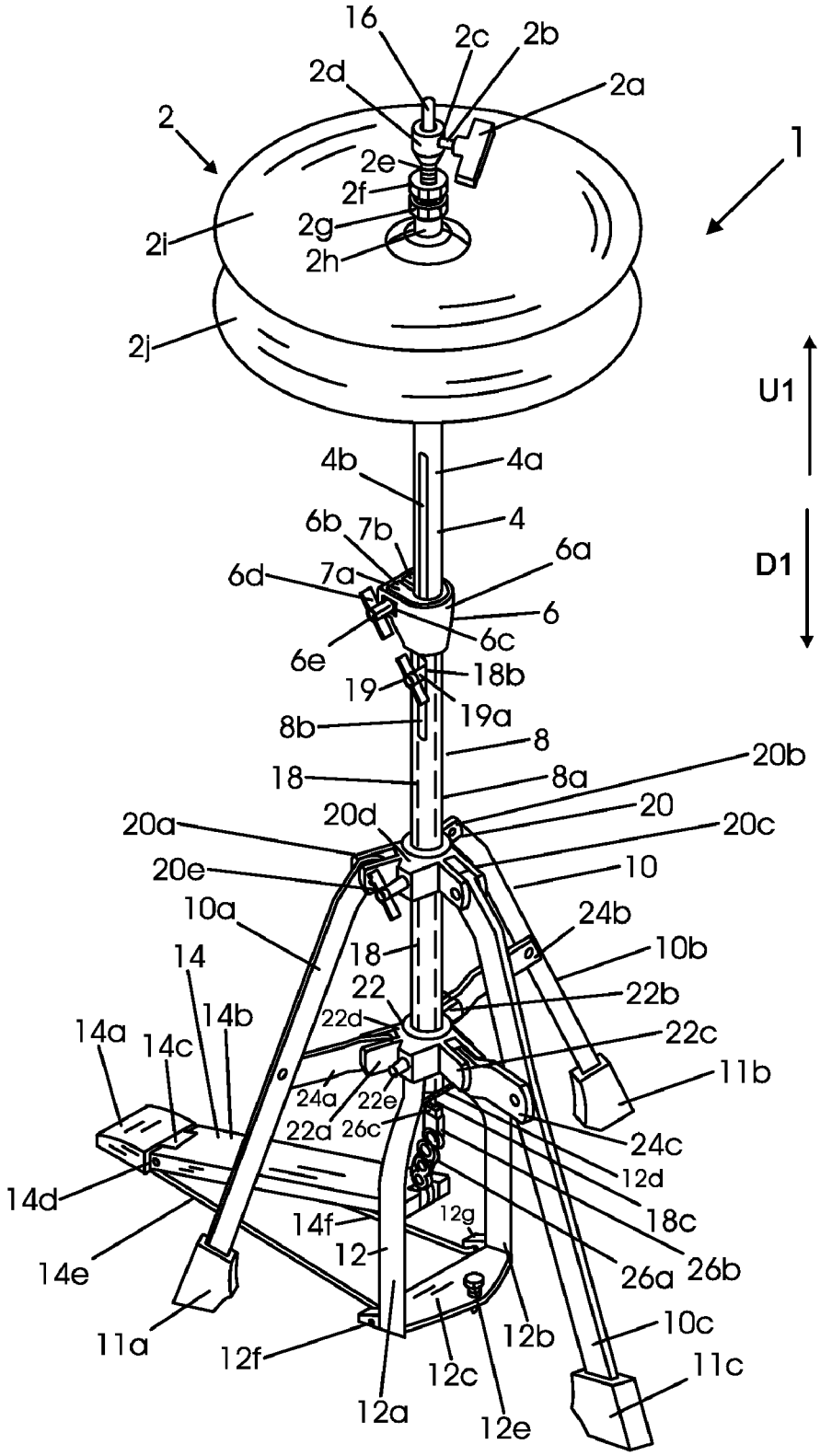
FIG. 1 shows a perspective view of an apparatus in accordance with an embodiment of the present invention, with the apparatus shown in a first state.
Figure 2:
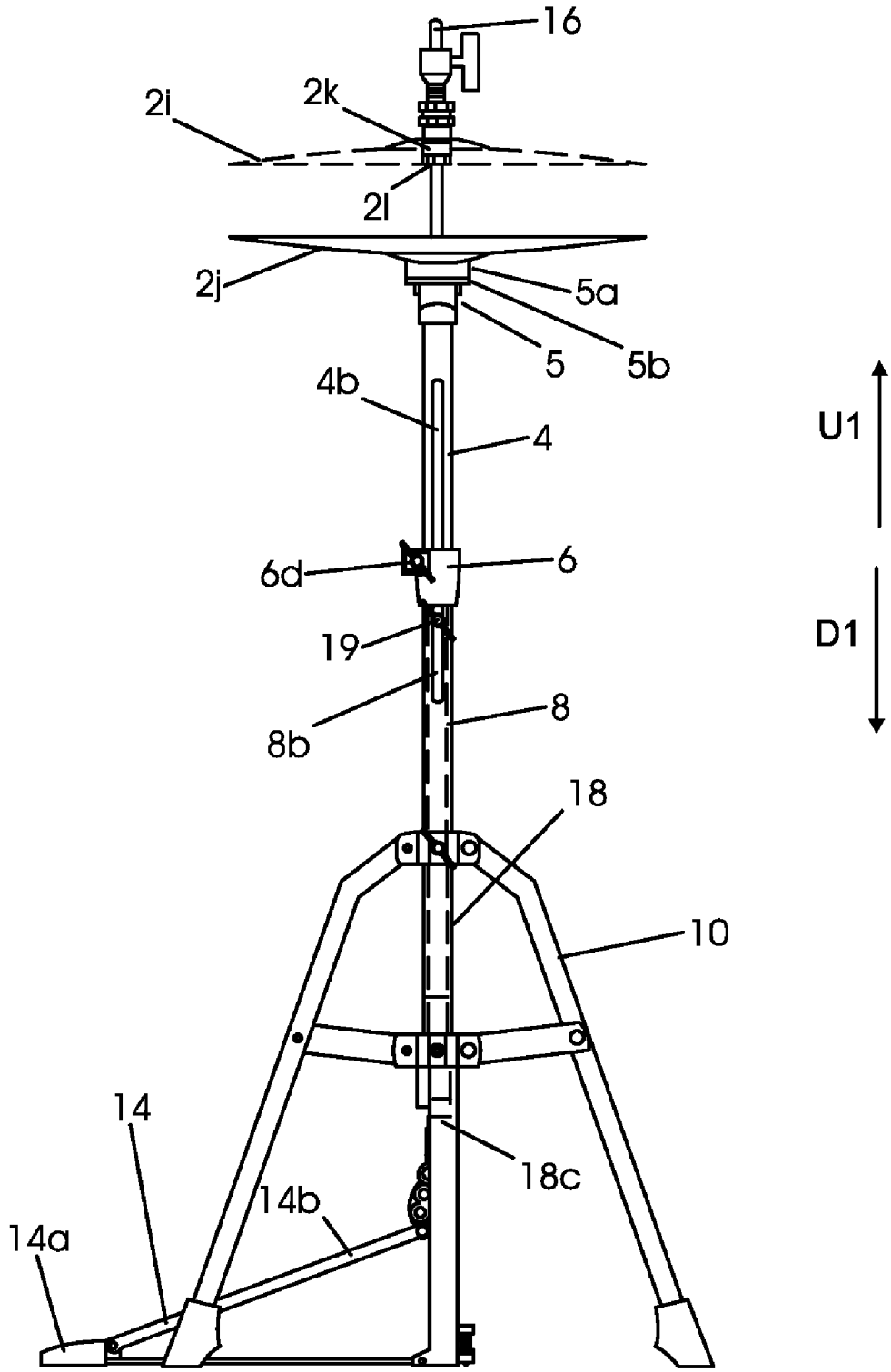
FIG. 2 shows a side view of the apparatus of FIG. 1, with the apparatus shown in the first state.

FIG. 1 shows a perspective view of an apparatus 1 in accordance with an embodiment of the present invention, with the apparatus 1 shown in a first state. FIG. 2 shows a side view of the apparatus of FIG. 1, with the apparatus shown in the first state, and with a top drum cymbal 2*i* shown in dashed lines, so that a bushing 2*k* and a nut 2*l* underneath the top drum cymbal 2*i* can be seen in FIG. 2. The apparatus 1 may be referred to as a drum high hat device or drum hi hat device in accordance with an embodiment of the present invention. The apparatus 1 includes cymbal or hi hat device 2, third tube device 4, adjustment device 6, first tube device 8, support device 10, support device 12, pedal device 14, a rod 16, and a second tube device 18 (whose location is shown by dashed lines in FIG. 1).

The cymbal device 2 includes wing screw 2*a* having a protrusion 2*b*, tube 2*d* having a threaded extension 2*e*, adjustment nuts 2*f* and 2*g*, and bushing 2*h*. The cymbal device 2 also includes drum cymbals 2*i* and 2*j*. The cymbal device 2 may also include bushing 2*k* and nut 2*l* shown in FIG. 2, but not shown in FIG. 1 (because bushing 2*k* and nut 21 are covered in FIG. 1 by cymbal 2*i*) between drum cymbals 2*i* and 2*j*, directly underneath drum cymbal 2*i*. The components 2*a*-2*h*, 2*k*, and 2*l* are used to fix the top cymbal 2*i* to the rod 16. The wing screw 2*a* can be used to adjust the height of the top cymbal 2*i* on the rod 16, so that different amounts of the rod 16 will extend out from the tube 2*d* depending on where the wing screw 2*a* is fixed on the rod 16. The cymbal device 2 is known in the art.

The tube device 4 includes a body portion 4*a* which is shaped in the form of a hollow cylinder, except for a slot 4*b*. The slot 4*b* may be elongated and may have a length of L2, shown in FIG. 4, which may be twelve inches and a width of W6 which may be about three-eighths of an inch. The body portion 4*a* may have a total length of about 14 inches and an outer width W7 of about seven-eighths of an inch.

The tube device 4 also includes a cymbal tilting device 5. The cymbal tilting device 5 includes a portion 5*b* and a bushing 5*a*. The portion 5*b* can be used to tilt the bushing 5*a* so that the cymbals 2*i* and 2*j* are tilted. A screw 5*c*, shown in FIG. 4 can be used to tilt the bushing 5*a* and thereby the cymbals 2*i* and 2*j*. The cymbal tilting device 5 has a hollow tube 5*d* running through it. The cymbal tilting device 5 is known in the art. However, in the prior art a cymbal tilting device identical to 5 is attached to a hollow cylinder which does not have a slot like elongated slot 4*b* in FIG. 4.

The adjustment device 6, shown in FIG. 1, includes a body portion 6*a*, an insert portion 6*b*, and a wing screw device 6*d*. The wing screw device 6*d* has a threaded cylindrical protrusion 6*e* which can be screwed into a threaded interior opening 6*c* in the body portion 6*a* and in the insert portion 6*b*. The insert portion 6*b* includes sections 7*a* and 7*b*. Turning the wing screw device 6*d* in a clockwise direction causes the sections 7*a* and 7*b* to come closer together and thereby tighten around the outside of body portion 4*a* of the tube device 4. This causes the tube device 4 and body portion 4*a* to be held fixed onto the tube device 8 by the sections 7*a* and 7*b*, so that the body portion 4*a* does not slide up in the direction U1 or down in the direction D1, with respect to the tube device 8, shown in FIG. 1. The wing screw device 6*d* can be loosened in a counter clockwise direction so that the body portion 4*a* or the tube device 4 can be slid up in the direction U1 or down in the direction D1. The adjustment device 6 is known in the art.

The tube device 8 is a substantially cylindrical hollow tube having a body portion 8*a* and a slot 8*b*. The slot 8*b* may be elongated and may have a length of three and one half inches and a width of three-eighths of an inch. The adjustment device 6 is fixed to the tube device 8. In the prior art an adjustment device 6 is fixed to a hollow cylinder which does not have a slot like elongated slot 8*b*.

Referring to FIG. 1, the support device 10 includes legs 10*a*, 10*b*, and 10*c*, having feet 11*a*, 11*b*, and 11*c*, respectively. The support device 10 further includes brackets 20 and 22. Bracket 20 includes extensions 20*a*, 20*b*, and 20*c*, which are pivotally connected to legs 10*a*, 10*b*, and 10*c*, respectively. Bracket 22 includes extensions 22*a*, 22*b*, and 22*c*, which are pivotally connected to members 24*a*, 24*b*, and 24*c*, which are pivotally connected near the middle of legs 10*a*, 10*b*, and 10*c*. The bracket 20 includes a body portion 20*d*. A wing screw device 20*e* having a threaded cylindrical protrusion can be screwed into an opening in body portion 20*d* to fix the bracket 20 onto the tube device 8 so the bracket 20 does not move up in the direction U1 or down in the direction D1 with respect to the tube device 8. Similarly, the bracket 22 includes a body portion 22*d*. A screw device 22*e* having a threaded cylindrical protrusion can be screwed into an opening in body portion 22*d* to fix the bracket 22 onto the tube device 8 so the bracket 22 does not move up in the direction U1 or down in the direction D1 with respect to the tube device 8.

The support device 12 includes legs 12*a* and 12*b*, base 12*c*, and connecting portion 12*d* which connects legs 12*a* and 12*b*, and includes a tube extension aligned with tube device 8. The support device 12 also includes a screw and spring device 12*e* which helps to keep the apparatus 1 balanced. The support device 12 is known in the art.

The pedal device 14 includes a base portion 14*a* which is connected to a foot portion 14*b* so that the foot portion 14*b* can pivot with respect to the base portion 14*a*. The base portion 14*a* may include an extension 14*c* which is pivotally connected to the foot portion 14*b* through a pivot point 14*d*. The base 14*a* is also fixed to proximal ends of members 14*e* and 14*f*. Distal ends of members 14*e* and 14*f* are pivotally connected to extensions 12*f* and 12*g*, respectively, of the support device 12. The pedal device 14 also includes a chain 26*a*, a nut 26*b*, and a nut 26*c*. A threaded end 18*c* of a tube device 18 can be screwed into the nut 26*c* and the nut 26*b* to attach the tube device 18 to the chain 26*a* and thereby the foot portion 14*b* of the pedal device 14.

Figure 4:
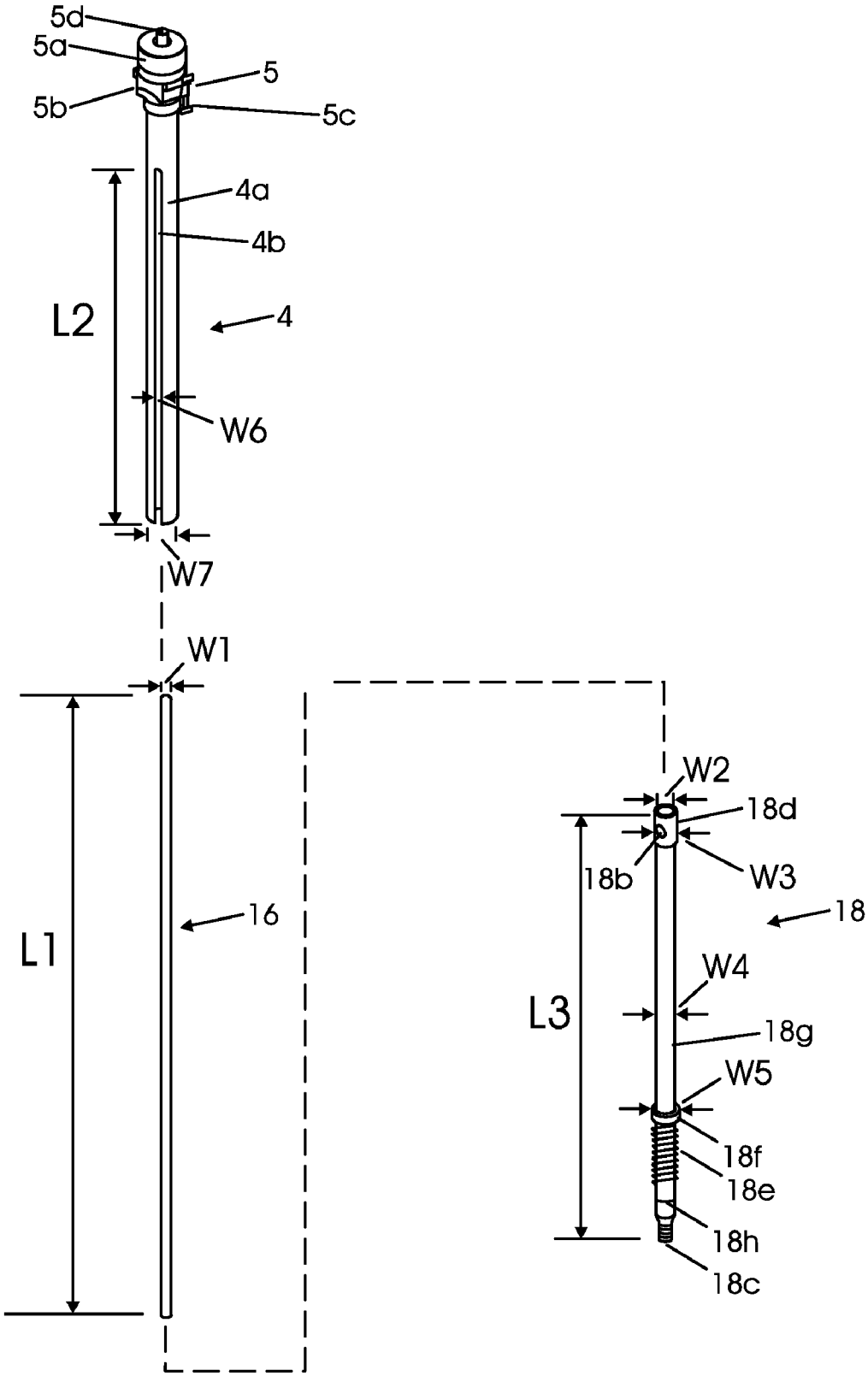
FIG. 4 shows a perspective view of a third tube device, a rod, and a second tube device of the apparatus of FIG. 1.

The rod 16 is shown in FIG. 4 and may be elongated and may have a length L1 of about nineteen and one half inches and a diameter, W1, of about one quarter of an inch. The rod 16 is known in the art.

Figure 5A:
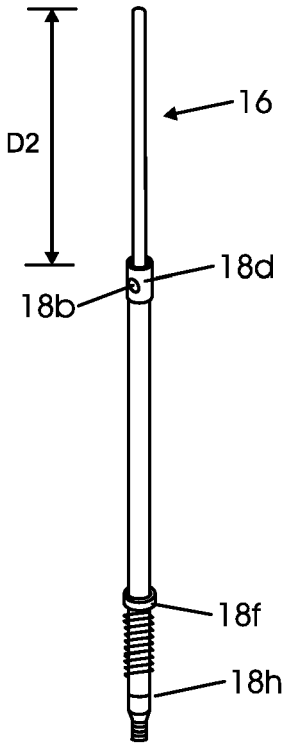
FIG. 5A shows a perspective view of the rod of FIG. 4 placed inside of the second tube device of FIG. 4, with the rod extending out a first distance from the second tube device.

The tube device or second tube device 18 is shown in FIG. 4, and the location of the tube device 18 is shown by dashed lines in FIG. 1. The tube device 18 may be elongated and may have a length L3 of about fifteen and one half inches. The tube device 18 has a fixed cap portion 18*d* with a threaded opening 18*b* whose location is shown in FIG. 1 and FIG. 4. The cap portion 18*d* has an inner diameter of W2, which is slightly larger than the diameter W1 of the rod 16, so that the rod 16 can pass into the inner cavity or inner chamber of the hollow cap portion 18*d*, and into the inner cavity or chamber of the hollow body portion 18*g*, and end at stopper 18*h* so that it doesn't pass through end 18*c* of the tube device 18. End 18*c* is solid so that rod 16 does not pass through tube device 18. The tube device 18 has a hollow cylindrical body portion 18*g*, and a washer 18*f* fixed at about four inches from the bottom end 18*c*. A spring 18*e* surrounds the body portion 18*g* just below the washer 18*f*. The washer 18*f* has an outer diameter of W5 which is greater than the inner diameter of the spring 18*e* so that the spring 18*e* cannot pass by the washer 18*f*. FIG. 5A shows the rod 16 inserted into the hollow inner chamber of the tube device or second tube device 18.

Figure 5B:
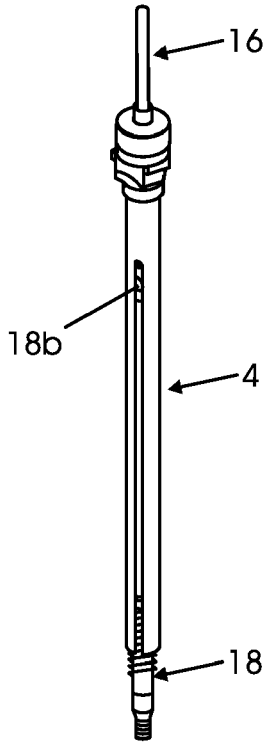
FIG. 5B shows a perspective view of the rod of FIG. 4 placed inside of the second tube device of FIG. 4 and the rod and second tube device placed inside of the third tube device of FIG. 4.

The outer diameter of the cap portion 18*d*, the outer diameter W5 of the washer, the outer diameter W4 of the body portion 18*g* of the tube device 18, and the outer diameter of the spring 18*e*, are less than the inner diameter W7 of the tube device 4, so that the tube device 18 fits inside of the hollow inner chamber of the body portion 4*a* of the tube device 4. FIG. 5B shows the rod 16 inserted inside the second tube device 18 and the third tube device 4 placed over the rod 16 and the second tube device 18.

In the first state, shown in FIG. 1 and in FIG. 2, the foot portion 14*b* of the pedal device 14 has not been pressed down in the direction D1, such as by stepping on the foot portion 14*b*. In the state of FIGS. 1 and 2, the cymbals 2*i* and 2*j* are a distance apart as shown in FIG. 2. When an individual applies pressure downward on the foot portion 14*b* in the direction D1, the chain 26*a* is pulled down in the direction D1 by the foot portion 14*b*. In addition, the nuts 26*b* and 26*c*, and the end 18*c* of the tube device 18 are also pulled down in the direction D1, by the chain 26*a*. As the tube device 18 is pulled downwards in the direction D1, the spring 18*e* is compressed by the washer 18*f* pressing down on one end of spring 18*e*, and a narrow opening of a tube of connecting portion 12*d* which does not allow the other end of the spring 18*e* to move downwards in the direction D1. The downward foot pressure results in the apparatus 1 changing from the first state of FIG. 2 to the second state of FIG. 3.

Figure 3:
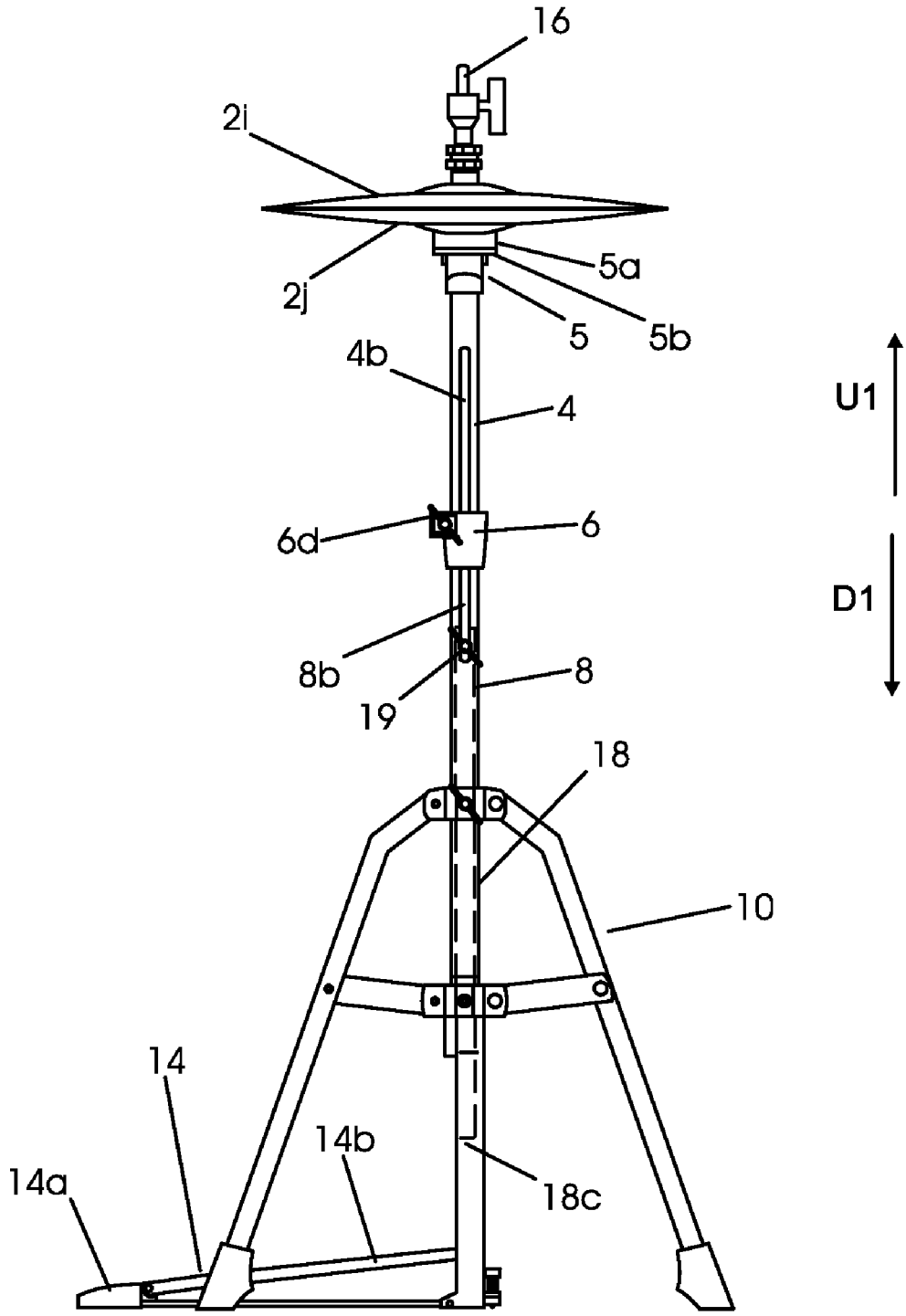
FIG. 3 shows a side view of the apparatus of FIG. 1, with the apparatus shown in a second state.

In the second state of FIG. 3, the cymbals 2*i* and 2*j* have come together. The end 18*c* of the tube device 18 has moved downward from the state of FIG. 2. The protrusion, screw, or fastener portion 19*a* of wing screw 19 moves downward in the direction D1 in the slot 8*b* of the first tube device 8, in going from the state of FIG. 2 to the state of FIG. 3.

The protrusion or fastener 19*a* of the wing screw 19 contacts and holds the rod 16 in a first position with respect to the tube device 18, when the wing screw device 19 is tightened. This allows the amount that the rod 16 extends out from the second tube device 18 to be adjusted by loosening the wing screw device 19, so that the protrusion 19*a* of the wing screw device 19 no longer holds the rod 16, sliding the rod 16 with respect to the second tube device 18, and then tightening the wing screw 19 to hold the rod 16 to the second tube device 18. The height of the bottom cymbal 2*j* can be adjusted by loosening the wing screw device 6*d*, which allows the third tube device 4 to slide up in the direction U1 or down in the direction D1 with respect to and inside of the inner chamber of the first tube device 8. The wing screw 6*d* can then be tightened to fix the height of the third tube device 4 (and bottom cymbal 2*j*) with respect to the tube device 8.

The slot 4*b* allows the tube device 4 to slide up and down (when wing screw device 6*d* is loosened) without being prevented by the wing screw device 19. The slot 8*b* allows the tube device 18 to slide up and down within the inner chamber of the first tube device 8.

The present invention in one or more embodiments provides a method and apparatus would avoids the use of multiple size rods for rod 16.

Figure 6:
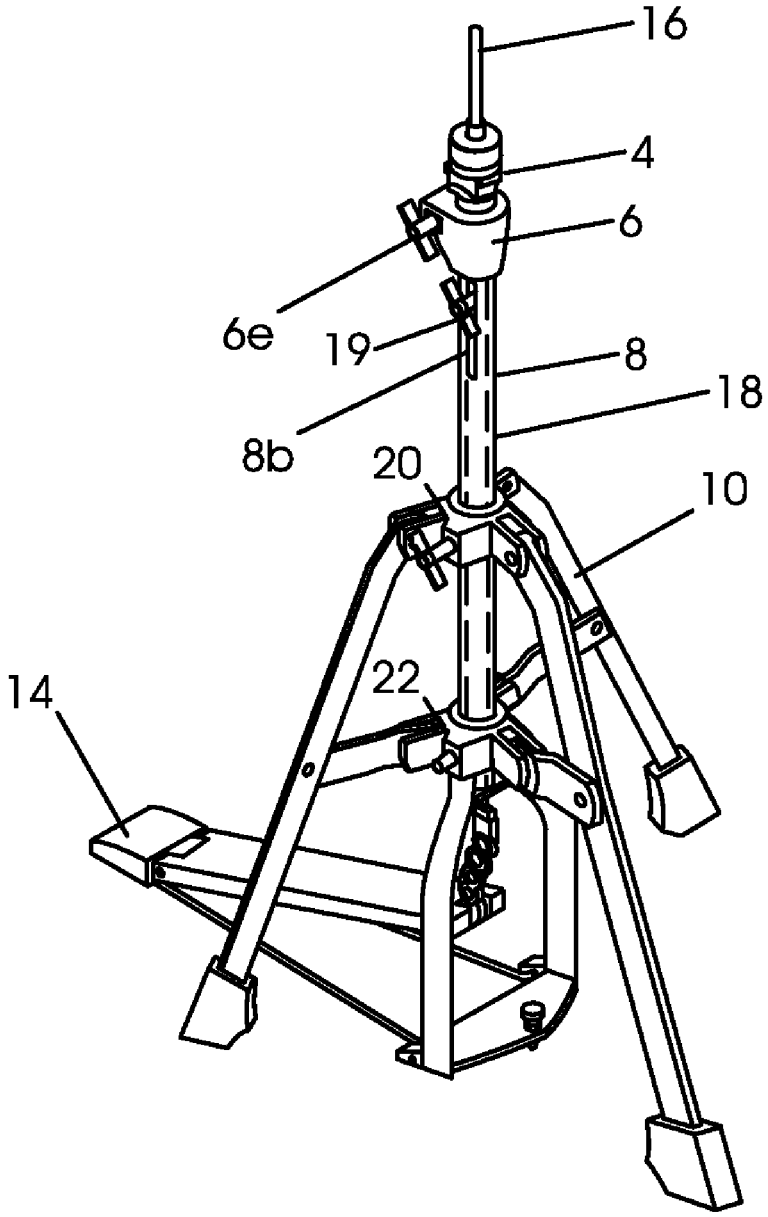
FIG. 6 shows a perspective view of a portion of the apparatus of FIG. 1, with the portion shown in a third state.
Figure 7:
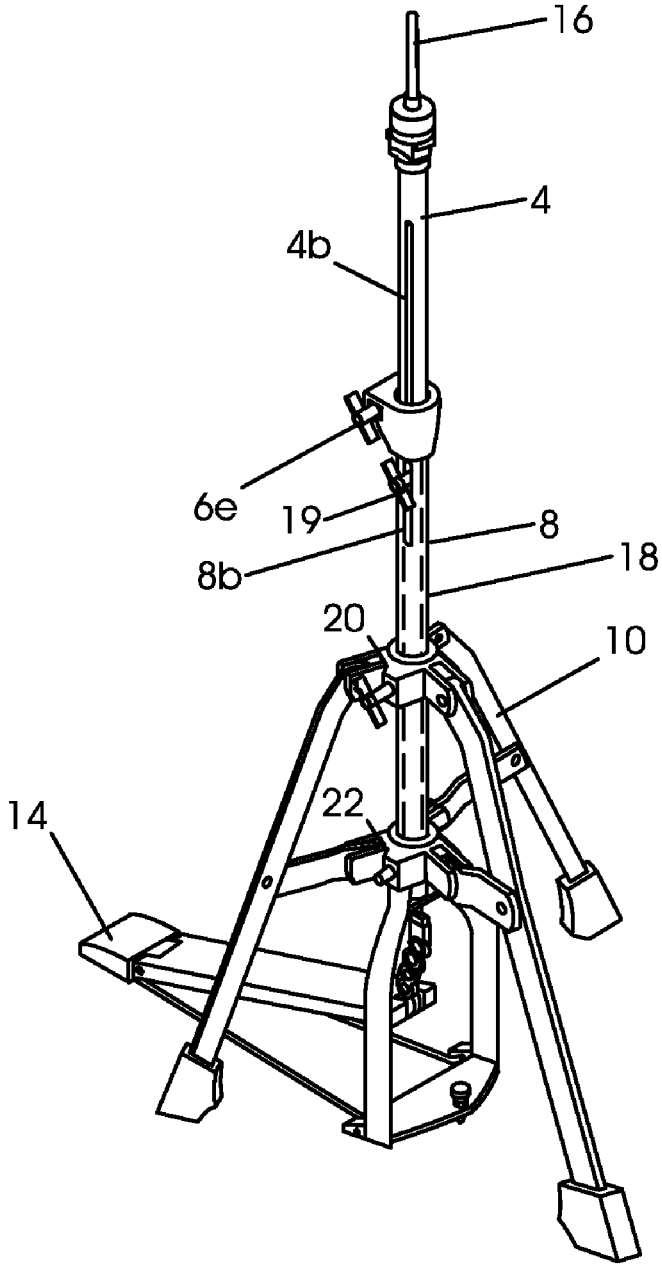
FIG. 7 shows a perspective view of a portion of the apparatus of FIG. 1, with the portion shown in a fourth state.

FIG. 6 shows a perspective view of a portion of the apparatus 1 of FIG. 1, with the portion shown in a third state. FIG. 7 shows a perspective view of a portion of the apparatus 1 of FIG. 1, with the portion shown in a fourth state. The cymbal device 2 is not shown in FIG. 6 or in FIG. 7.

In FIG. 6 the tube device or third tube device 4 has been pushed downwards into the tube device or first tube device 8. In FIG. 7, the tube device 4 has been moved upwards and the wing screw device 6*d* has been tightened to hold the tube device 4 in a fixed position with respect to the tube device 8. In this manner the lower cymbal 2*j* can be adjusted. The slot 4*b* of the tube device 4 overlaps and is aligned with the slot 8*b* of the tube device 8 so that the wing screw device 19 does not impede the movement of the tube device 4 with respect to the tube device 8. The location of the tube device or second tube device 18 within the tube device or first tube device 8 is shown by dashed lines in FIGS. 6 and 7.

The apparatus 1 can be constructed as follows. The tube device 8, which can be described as a first tube device or base tube device, can be placed in an upright position by using support device 10, as in FIG. 1. The tube device 18, which can be described as a second tube device, shown in FIG. 4, can be inserted into the tube device 8 as shown by dashed lines in FIGS. 1, 2, and 3. The tube device 8 is a hollow cylinder with the exception of the elongated slot 8*b*. The tube device 8 has an inner cavity or chamber into which the tube device 18 can be inserted. After the second tube device 18 has been inserted into the inner cavity or chamber of the first tube device 8, the threaded end 18*c* of the tube device 18 shown in FIG. 4 can be attached to the foot portion 14*b* of the pedal device 14 through nut 26*c*, nut 26*b*, and chain 26*a* shown in FIG. 1.

With the second tube device 18 inside the inner cavity or chamber of the first tube device 8, the opening 18*b* of the cap portion 18*d* of the tube device 18 is aligned with the slot 8*b*, as shown by FIG. 1. The tube device 4, or third tube device can then be inserted into the first tube device 8 so that the third tube device 4 at least partially surrounds the second tube device 18. The slot 4*b* is also aligned with the slot 8*b*. The tube device 4 can be fixed with respect to the tube device 8 by tightening wing screw device 6*d* of adjustment device 6 to cause protrusion 6*c* to tighten sections 7*a* and 7*b*, to hold the third tube device 4 at a fixed position with respect to the first tube device 8. The fixing of the third tube device 4 with respect to the first tube device 8, fixes the height of the lower cymbal 2*j*.

Figure 5C:
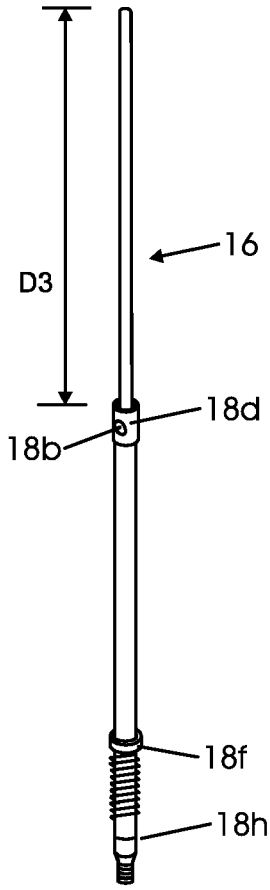
FIG. 5C shows a perspective view of the rod of FIG. 4 placed inside of the second tube device of FIG. 4 so that the rod extends out a different distance than in FIG. 5A.

The rod 16 can be inserted into the hollow tube 5*d*, pushed through a cavity or inner chamber of body portion 4*a* of the tube device 4, and into the inner chamber or cavity of the second tube device 18 as shown by FIGS. 5A, 5B, and 5C. The rod 16 can be fixed in place with respect to the second tube device 18 by inserting protrusion, screw, or fastener 19*a* of wing device 19 through the slot 8*b*, through the slot 4*b*, into the opening 18*b*, and into contact with the rod 16. The slots 8*b* and 4*b* allow the wing device 19, and the protrusion 19*a* to move up and down as shown by FIGS. 2 and 3. The rod 16 can be fixed to the second tube device 18 by screw or fastener 19*a* of wing device 19, through opening 18*b*, so that the rod 16 extends out from the second tube device 18 different distances, such as distance D2 shown in FIG. 5A or distance D3 shown in FIG. 5C. The rod 16 can be fixed to the second tube device 18 so that the rod 16 extends out various other distances, other than D2 and D3. This allows a drummer to adjust the rod 16 with respect to the second tube device 18 so that a very small portion of the rod 16, if any, would extend beyond the tube 2*d* of the cymbal device 2, shown in FIG. 1, when the cymbals 2*i* and 2*j* are set at the height desired by the drummer. In contrast, in the prior art, a rod is connected to another rod so that the two rod combination is not adjustable in height.

In addition, in one or more embodiments of the present invention, Inserting the rod 16 further into the tube device 18 allows the apparatus 1 to be more easily transported without taking the rod 16 out of the tube device 18, but rather telescopically inserting the rod 16 into the tube device 18 to compress the apparatus 1, after the cymbal device 2 is removed.

The cymbal components 2*a*-2*h* above the top cymbal 2*i* shown in FIG. 1 and components 2*k* and 2*l* shown in FIG. 2 can be attached after the rod 16 has been fixed with respect to the second tube device 18 by wing device 19.

With the rod 16 fixed to the second tube device 18 by the wing device 19 and fastener 19*a*, when the pedal foot portion 14*b* is not being depressed down as shown in FIG. 2, the second tube device 18 and rod 16 are at their rest state, with the cymbal 2*i* shown a distance above the cymbal 2*j*. When the foot portion 14*b* is pressed down in the direction D1 as shown in FIG. 3, foot portion 14*b* pulls down on chain 26*a*, nuts 26*b*-*c*, and thereby pulls down second tube device 18 (shown in dashed lines). The second tube device 18 which has been attached to rod 16 by wing device 19, pulls down rod 16 and thereby pulls down top cymbal 2*i* and components 2*a*-2*h*, 2*k* and 2*l*

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a first tube device;

a second tube device;

a third tube device having a first end which is configured to have a first cymbal placed on it;

a rod, wherein the rod fits within the first, second, and third tube devices;

a support device, wherein the support device is configured so that it is able to support the first tube device in an upright position;

a pedal device, wherein the pedal device is connected to the second tube device, which is adjustably fixed to the rod, so that the pedal device can pull down the second tube device and thereby pull down a second cymbal fixed to the rod to bring the second cymbal in contact with the first cymbal;

wherein the second tube device fits within both the first tube device and the third tube device;

wherein the third tube device fits within the first tube device;

and further comprising a first adjustment device which is configured so that it can fix the rod to the second tube device at different positions so that the rod extends out different amounts from the second tube device.

2. The apparatus of claim 1 wherein the first tube device has a first elongated slot;

the third tube device has a second elongated slot; and wherein the first and the second elongated slots can be aligned with each other so that a portion of the first adjustment device can move within both the first elongated slot and the second elongated slot at the same time.

3. The apparatus of claim 1 wherein the first adjustment device includes a screw which can be tightened to hold the second tube device and the rod together at different positions, or loosened so that the rod can slide with respect to the second tube device.

4. The apparatus of claim 1 wherein the second tube device includes a spring; and wherein the pedal device is connected to the second tube device so that pressing down on the pedal device causes compression of the spring, and ceasing to press down on the pedal device causes the spring to decompress.

5. The apparatus of claim 1 wherein the first tube device, the second tube device, and the third tube device include hollow cylinders.

6. The apparatus of claim 1 further comprising a second adjusting device which is configured so that it can fix the third tube device to the first tube device at different positions so that the third tube device extends out different amounts from the first tube device.

7. A method comprising supporting a first tube device in an upright position;

inserting a second tube device into the first tube device;

inserting a third tube device into the first tube device, so that the third tube device surrounds the second tube device;

inserting a rod into the first, second, and third tube devices;

attaching the rod to the second tube device by using a first adjustment device so that the rod extends out from the second tube device a first amount;

detaching the rod from the second tube device;

moving the rod with respect to the second tube device;

attaching the rod to the second tube device by using a first adjustment device so that the rod extends out from the second tube device a second amount which is different from the first amount; and placing a first cymbal on an end of the third tube device.

8. The method of claim 7 wherein the first tube device includes a first elongated slot;

the third tube device includes a second elongated slot;

and further comprising aligning the first elongated slot with the second elongated slot before attaching the rod to the second tube device.

9. The method of claim 7 wherein attaching the rod to the second tube device so that the rod extends out from the second tube device a first amount includes inserting a fastener into the second tube device which holds the rod in a fixed position with respect to the second tube device; and and attaching the rod to the second tube device so that the rod extends out from the second tube device a first amount includes inserting the fastener into the second tube device which holds the rod in a fixed position with respect to the second tube device.

10. The method of claim 9 wherein the second tube device has an opening for insertion of the fastener.

11. The method of claim 10 wherein the first tube device includes a first elongated slot;

the third tube device includes a second elongated slot;

and further comprising aligning the first elongated slot with the second elongated slot before attaching the rod to the second tube device;

and wherein the fastener is configured to fit through the first elongated slot, through the second elongated slot, through the opening of the second tube device, and contact with the rod in order to hold the rod in a fixed position with respect to the second tube device.

12. The method of claim 7 further comprising attaching the second tube device to a pedal device so that when an individual presses down on the pedal device the second tube device is pulled down, and the rod, when attached to the second tube device, is also pulled down.

13. The method of claim 12 wherein the second tube device includes a spring;

wherein pressing down on the pedal device causes compression of the spring, and ceasing to press down on the pedal device cause the spring to decompress.

14. The method of claim 7 wherein the first tube device, the second tube device, and the third tube device include hollow cylinders.

15. The method of claim 7 further comprising fixing the third tube device to the first tube device at different positions using a second adjustment device so that the third tube device extends out different amounts from the first tube device.

* * * * *